US009328739B2

(12) United States Patent
Atkinson

(10) Patent No.: US 9,328,739 B2
(45) Date of Patent: May 3, 2016

(54) FAN

(71) Applicant: Dyson Technology Limited, Wiltshire (GB)

(72) Inventor: Antoine Francois Atkinson, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 657 days.

(21) Appl. No.: 13/743,975

(22) Filed: Jan. 17, 2013

(65) Prior Publication Data

US 2013/0189083 A1 Jul. 25, 2013

(30) Foreign Application Priority Data

Jan. 19, 2012 (GB) ..... 1200899.1

(51) Int. Cl.

| | |
|---|---|
| ***F04D 29/42*** | (2006.01) |
| ***F01D 11/00*** | (2006.01) |
| ***F01D 25/00*** | (2006.01) |
| ***F04D 29/66*** | (2006.01) |
| ***F04D 25/08*** | (2006.01) |
| ***F04D 29/08*** | (2006.01) |
| ***F04D 29/60*** | (2006.01) |
| ***F04F 5/16*** | (2006.01) |

(52) U.S. Cl.

CPC ..... *F04D 29/4226* (2013.01); *F01D 11/005* (2013.01); *F01D 25/00* (2013.01); *F04D 25/08* (2013.01); *F04D 29/083* (2013.01); *F04D 29/601* (2013.01); *F04D 29/668* (2013.01); *F04F 5/16* (2013.01)

(58) Field of Classification Search

CPC . F04D 29/4226; F04D 29/668; F04D 29/083; F04D 29/601; F04D 25/08; F01D 11/005

See application file for complete search history.

(56) References Cited

U.S. PATENT DOCUMENTS

| | | | |
|---|---|---|---|
| 1,357,261 | A | 11/1920 | Svoboda |
| 1,767,060 | A | 6/1930 | Ferguson |

(Continued)

FOREIGN PATENT DOCUMENTS

| | | |
|---|---|---|
| AU | 201100923 | 9/2011 |
| BE | 560119 | 8/1957 |

(Continued)

OTHER PUBLICATIONS

International Search Report and Written Opinion mailed Oct. 14, 2013, directed to International Application No. PCT/GB2012/053100; 11 pages.

(Continued)

*Primary Examiner* — Ninh H Nguyen

(74) *Attorney, Agent, or Firm* — Morrison & Foerster LLP

(57) ABSTRACT

A fan includes an outer casing having an air inlet and an air outlet, and an impeller housing located within the casing. An impeller is provided within the impeller housing for generating an air flow along a path extending from the air inlet to the air outlet through the impeller housing. A motor for driving the impeller is located within a motor housing connected to the impeller housing. A foam annular seal is located between the impeller housing and a seat to inhibit the leakage of air between the impeller housing and the casing. A plurality of resilient supports is provided between the impeller housing and the seat to reduce the load on the annular seal.

14 Claims, 5 Drawing Sheets

(56) References Cited

U.S. PATENT DOCUMENTS 1,896,869 A 2/1933 Larsh
2,014,185 A 9/1935 Martin
2,035,733 A 3/1936 Wall
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,336,295 A 12/1943 Reimuller
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,339,867 A * 9/1967 Bayless ..... A47L 9/22 248/632
3,444,817 A 5/1969 Caldwell
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,502,837 A 3/1985 Blair et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,978,281 A * 12/1990 Conger, IV ..... F04D 25/082 264/271.1
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,518,370 A 5/1996 Wang et al.
5,609,473 A 3/1997 Litvin
5,645,769 A 7/1997 Tamaru et al.
5,649,370 A 7/1997 Russo
5,730,582 A 3/1998 Heitmann
5,735,683 A 4/1998 Muschelknautz
5,762,034 A 6/1998 Foss
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,065,936 A 5/2000 Shingai et al.
6,073,881 A 6/2000 Chen
6,082,969 A 7/2000 Carroll et al.
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,338,610 B1 1/2002 Harada et al.
6,348,106 B1 2/2002 Embree et al.
6,386,845 B1 5/2002 Bedard
6,454,527 B2 9/2002 Nishiyama et al.
6,480,672 B1 11/2002 Rosenzweig et al.
6,511,288 B1 1/2003 Gatley, Jr.
6,599,088 B2 7/2003 Stagg
D485,895 S 1/2004 Melwani
6,709,236 B1 3/2004 Hoelzer
6,752,711 B1 * 6/2004 Yeung ..... B08B 15/02 454/49
6,789,787 B2 9/2004 Stutts
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,186,075 B2 3/2007 Winkler et al.
7,189,053 B2 * 3/2007 Winkler ..... B29C 45/0062 415/108
7,241,214 B2 7/2007 Sixsmith
7,317,267 B2 1/2008 Schmid et al.
7,455,504 B2 11/2008 Hill et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 2/2010 Liao
D614,280 S 4/2010 Dyson et al.
7,775,848 B1 8/2010 Auerbach
7,806,388 B2 10/2010 Junkel et al.
7,921,962 B2 4/2011 Liddell
8,033,783 B2 10/2011 Ishikawa et al.
8,092,166 B2 1/2012 Nicolas et al.
8,430,624 B2 4/2013 Cookson et al.
8,469,658 B2 6/2013 Gammack et al.
2002/0015640 A1 2/2002 Nishiyama et al.
2002/0106547 A1 8/2002 Sugawara et al.
2003/0059307 A1 3/2003 Moreno et al.
2003/0171093 A1 9/2003 Gumucio Del Pozo
2004/0022631 A1 2/2004 Birdsell et al.
2004/0049842 A1 3/2004 Prehodka
2004/0149881 A1 8/2004 Allen

(56) References Cited

U.S. PATENT DOCUMENTS

| | | | |
|---|---|---|---|
| 2005/0031448 | A1 | 2/2005 | Lasko et al. |
| 2005/0053465 | A1 | 3/2005 | Roach et al. |
| 2005/0069407 | A1 | 3/2005 | Winkler et al. |
| 2005/0128698 | A1 | 6/2005 | Huang |
| 2005/0163670 | A1 | 7/2005 | Alleyne et al. |
| 2005/0173997 | A1 | 8/2005 | Schmid et al. |
| 2005/0276684 | A1 | 12/2005 | Huang et al. |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2007/0035189 | A1 | 2/2007 | Matsumoto |
| 2007/0041857 | A1 | 2/2007 | Fleig |
| 2007/0048159 | A1 | 3/2007 | DiMatteo et al. |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0152482 | A1 | 6/2008 | Patel |
| 2008/0166224 | A1 | 7/2008 | Giffin |
| 2008/0286130 | A1 | 11/2008 | Purvines |
| 2008/0304986 | A1 | 12/2008 | Kenyon et al. |
| 2008/0314250 | A1 | 12/2008 | Cowie et al. |
| 2009/0026850 | A1 | 1/2009 | Fu |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0191054 | A1 | 7/2009 | Winkler |
| 2009/0214341 | A1 | 8/2009 | Craig |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0219013 | A1 | 9/2010 | Liddell |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0002775 | A1 | 1/2011 | Ma et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |
| 2013/0011252 | A1 | 1/2013 | Crawford et al. |
| 2013/0045084 | A1 | 2/2013 | Tu et al. |
| 2013/0302156 | A1 | 11/2013 | Nurzynski |
| 2013/0309065 | A1 | 11/2013 | Johnson et al. |
| 2013/0309066 | A1 | 11/2013 | Atkinson et al. |
| 2013/0309080 | A1 | 11/2013 | Johnson et al. |
| 2013/0323025 | A1 | 12/2013 | Crawford et al. |
| 2014/0017069 | A1 | 1/2014 | Peters |

FOREIGN PATENT DOCUMENTS

| | | |
|---|---|---|
| CA | 1055344 | 5/1979 |
| CA | 2155482 | 9/1996 |
| CH | 346643 | 5/1960 |
| CN | 2085866 | 10/1991 |
| CN | 2111392 | 7/1992 |
| CN | 2228996 | 6/1996 |
| CN | 1232143 | 10/1999 |
| CN | 1288506 | 3/2001 |
| CN | 1336482 | 2/2002 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 101046318 | 10/2007 |
| CN | 201180678 | 1/2009 |
| CN | 201221477 | 4/2009 |
| CN | 201281416 | 7/2009 |
| CN | 201349269 | 11/2009 |
| CN | 101749288 | 6/2010 |
| CN | 201502549 | 6/2010 |
| CN | 101816534 | 9/2010 |
| CN | 101825095 | 9/2010 |
| CN | 101825102 | 9/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102305220 | 1/2012 |
| CN | 102367813 | 3/2012 |
| CN | 202165330 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 41 27 134 | 2/1993 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| DE | 10 2009 044 349 | 5/2011 |
| EP | 0 044 494 | 1/1982 |
| EP | 0186581 | 7/1986 |
| EP | 0 837 245 | 4/1998 |
| EP | 0 955 469 | 11/1999 |
| EP | 1 094 224 | 4/2001 |
| EP | 1 138 954 | 10/2001 |
| EP | 1 566 548 | 8/2005 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1.387.334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 6/1914 |
| GB | 383498 | 11/1932 |
| GB | 593828 | 10/1947 |
| GB | 601222 | 4/1948 |

(56) References Cited

FOREIGN PATENT DOCUMENTS

| | | |
|---|---|---|
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 237 323 | 5/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 490 | 3/2009 |
| GB | 2 452 593 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-51608 | 5/1978 |
| JP | 53-60100 | 5/1978 |
| JP | 56-167897 | 12/1981 |
| JP | 57-71000 | 5/1982 |
| JP | 57-157097 | 9/1982 |
| JP | 59-90797 | 5/1984 |
| JP | 59-167984 | 11/1984 |
| JP | 60-105896 | 7/1985 |
| JP | 61-31830 | 2/1986 |
| JP | 61-116093 | 6/1986 |
| JP | 61-280787 | 12/1986 |
| JP | 62-223494 | 10/1987 |
| JP | 63-179198 | 7/1988 |
| JP | 63-306340 | 12/1988 |
| JP | 64-21300 | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-3419 | 1/1991 |
| JP | 3-52515 | 5/1991 |
| JP | 3-267598 | 11/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 7-247991 | 9/1995 |
| JP | 8-21400 | 1/1996 |
| JP | 9-100800 | 4/1997 |
| JP | 9-287600 | 11/1997 |
| JP | 10-122188 | 5/1998 |
| JP | 11-227866 | 8/1999 |
| JP | 2000-116179 | 4/2000 |
| JP | 2000-201723 | 7/2000 |
| JP | 2001-17358 | 1/2001 |
| JP | 2001-295785 | 10/2001 |
| JP | 2002-21797 | 1/2002 |
| JP | 2002-138829 | 5/2002 |
| JP | 2002-213388 | 7/2002 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-92697 | 4/2007 |
| JP | 2007-138763 | 6/2007 |
| JP | 2007-138789 | 6/2007 |
| JP | 2008-39316 | 2/2008 |
| JP | 2008-100204 | 5/2008 |
| JP | 2008-151081 | 7/2008 |
| JP | 3146538 | 10/2008 |
| JP | 2008-294243 | 12/2008 |
| JP | 2009-44568 | 2/2009 |
| JP | 2009-264121 | 11/2009 |
| JP | 2010-131259 | 6/2010 |
| JP | 2012-36897 | 2/2012 |
| JP | 2012-57619 | 3/2012 |
| KR | 2002-0061691 | 7/2002 |
| KR | 2002-0067468 | 8/2002 |
| KR | 10-2005-0102317 | 10/2005 |
| KR | 2007-0007997 | 1/2007 |
| KR | 10-2010-0055611 | 5/2010 |
| KR | 2000-0032363 | 6/2010 |
| KR | 10-0985378 | 9/2010 |
| TW | M394383 | 12/2010 |
| TW | M407299 | 7/2011 |
| WO | WO-90/13478 | 11/1990 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO 2005/057091 | 6/2005 |
| WO | WO-2006/008021 | 1/2006 |
| WO | WO-2006/012526 | 2/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2009/030879 | 3/2009 |
| WO | WO-2009/030881 | 3/2009 |
| WO | WO-2010/100448 | 9/2010 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |
| WO | WO-2011/055134 | 5/2011 |

OTHER PUBLICATIONS

Hodgson et al., U.S. Office Action mailed Mar. 24, 2014, directed to U.S. Appl. No. 13/207,212; 10 pages.

Search Report dated Apr. 26, 2012, directed to GB Application No. 1200899.1, 1 page.

(56) References Cited

OTHER PUBLICATIONS

Gammack, P. et al., U.S. Office Action mailed Dec. 9, 2010, directed to U.S. Appl. No. 12/203,698; 10 pages.
Gammack, P. et al., U.S. Office Action mailed Jun. 21, 2011, directed to U.S. Appl. No. 12/203,698; 11 pages.
Gammack et al., Office Action mailed Sep. 17, 2012, directed to U.S. Appl. No. 13/114,707; 12 pages.
Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl. No. 12/230,613; 13 pages.
Gammack, P. et al., U.S. Office Action mailed Sep. 7, 2011, directed to U.S. Appl. No. 12/230,613; 15 pages.
Gammack, P. et al., U.S. Office Action mailed Jun. 8, 2012, directed to U.S. Appl. No. 12/230,613; 15 pages.
Gammack et al., U.S. Office Action mailed Aug. 20, 2012, directed to U.S. Appl. No. 12/945,558; 15 pages.
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Nov. 29, 2012, directed to U.S. Appl. No. 12/716,742; 9 pages.
Cookson, M. et al., U.S. Office Action mailed Dec. 19, 2012, directed to U.S. Appl. No. 12/716,778; 8 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Atkinson et al., U.S. Office Action mailed Dec. 17, 2015, directed to U.S. Appl. No. 13/895,691; 11 pages.

* cited by examiner

FAN

REFERENCE TO RELATED APPLICATIONS

This application claims the priority of United Kingdom Application No. 1200899.1, filed Jan. 19, 2012, the entire contents of which are incorporated herein by reference.

FIELD OF THE INVENTION

The present invention relates to a fan. Particularly, but not exclusively, the present invention relates to a floor or table-top fan, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generated located within a cage which allows an air flow to pass through the housing while preventing users from coming into contact with the rotating blades during use of the fan.

WO 2009/030879 describes a fan assembly which does not use caged blades to project air from the fan assembly. Instead, the fan assembly comprises a cylindrical base which houses a motor-driven impeller for drawing a primary air flow into the base, and an annular nozzle connected to the base and comprising an annular air outlet through which the primary air flow is emitted from the fan. The nozzle defines a central opening through which air in the local environment of the fan assembly is drawn by the primary air flow emitted from the mouth, amplifying the primary air flow.

WO 2010/100452 also describes such a fan assembly. Within the base, the impeller is located within an impeller housing, and the motor for driving the impeller is located within a motor bucket which is mounted on the impeller housing. The impeller housing is supported within the base by a plurality of angularly spaced supports. Each support is, in turn, mounted on a respective support surface extending radially inwardly from the inner surface of the base. In order to provide an air tight seal between the impeller housing and the base, a lip seal is located on an external side surface of the impeller housing for engaging the internal side surface of the base.

SUMMARY OF THE INVENTION

The present invention provides a fan comprising a casing having an air inlet and an air outlet, an impeller housing mounted on an annular seat located within the casing, an impeller located within the impeller housing for generating an air flow along a path extending from the air inlet to the air outlet through the impeller housing, a motor housing connected to the impeller housing, a motor located within the motor housing for driving the impeller, an annular seal in sealing engagement with the impeller housing and the seat, and at least one resilient support located between the impeller housing and the seat for reducing the compressive load applied to the annular seal.

The fan assembly thus comprises both an annular seal and at least one resilient support located between the impeller housing and a seat upon which the impeller housing is mounted. The compression of the annular seal between the impeller housing and the seat forms an air tight seal which prevents air from leaking back towards the air inlet of the casing along a path extending between the casing and the impeller housing, and so forces the pressurized air flow generated by the impeller to pass to the air outlet of the casing.

The annular seal is preferably a foam annular seal. Forming the annular seal from a foam material, as opposed to an elastomeric or rubber material, can reduce the transmission of vibrations to the casing through the annular seal. The resilient support(s) are also disposed between the impeller housing and the seat so as to bear some of the combined weight of the impeller housing, impeller, motor housing and motor, and thereby reduce the compressive load acting on the annular seal. This reduces the extent of the deformation of the annular seal; an excessive compression of the annular seal between the impeller housing and the seat could result in an undesirable increase in the transmission of the vibrations from the motor housing to the casing through the annular seal.

The compressive force acting on the annular seal is preferably aligned with the direction of the greatest stiffness of the surface from which the vibrations are to be isolated, that is, the casing of the fan. In a preferred embodiment, this direction is parallel to the longitudinal axis of the casing. The annular seal is preferably spaced from the inner surface of the casing so that vibrations are not transferred radially outwardly from the annular seal to the casing.

In addition to forming an air-tight seal between the impeller housing and the casing, the annular seal can also provide a damping action for reducing the vibration of the resilient support(s) during use of the fan assembly, and so reduce the transmission of the vibrations from the motor housing to the casing through the resilient support(s).

The annular seal is preferably formed from material which exhibits no more than 0.01 MPa of stress at 10% compression. In a preferred embodiment, the annular seal is formed from a closed cell foam material. The foam material is preferably formed from a synthetic rubber, such as EPDM (ethylene propylene diene monomer) rubber.

The impeller housing may be provided with a recessed section defining an annular channel for receiving the seal. The recessed section of the impeller housing preferably comprises a seal engaging surface, for example a flange, which extends radially outwardly from the impeller housing and generally parallel to the seat, and which is in sealing engagement with the seal.

The fan may comprise means for inhibiting rotation of the seal relative to the impeller housing. External peripheries of both the recessed section of the impeller housing and the seal may be non-circular or otherwise shaped to inhibit rotation of the seal within the annular channel. For example, the external peripheries of both the recessed section of the impeller housing and the seal may be scalloped. Alternatively, or additionally, the seat may comprise means for inhibiting rotation of the seal relative to the impeller housing.

The resilient support(s) preferably extend about the annular seal. The fan may comprise a single, annular resilient support. Alternatively, the fan may comprise a plurality of resilient supports. The resilient supports are preferably angularly spaced about the impeller housing. To reduce the width of the casing, the internal or external periphery of the annular seal may be scalloped or otherwise profiled to form a plurality of recesses each for at least partially accommodating a respective resilient support. Alternatively, the annular seal may be provided with a plurality of apertures, with each resilient support extending through a respective aperture.

The, or each resilient support may comprise a respective spring. Alternatively, each resilient support may be formed from an elastomeric material. For example, a single annular resilient support may be provided in the form of a bellows support arranged about the impeller housing. Where the fan comprises a plurality of resilient supports, each support may comprise a rod or shaft formed from rubber or other resilient or elastomeric material.

The fan preferably comprises means for inhibiting angular movement of the impeller housing, that is, about the rotational axis of the impeller, relative to the seat. For example, the fan may comprise means for inhibiting angular movement of the resilient support(s) relative to the seat. The seat may be provided with one or more stop members for engaging the resilient support(s) to prevent movement of the resilient support(s) along the seat. The stop members may be in the form of raised or recessed portions of the seat. The fan may also comprise means for inhibiting angular movement of the resilient support(s) relative to the impeller housing. For example, the impeller housing may comprise one or more stop members for engaging the resilient support(s) to prevent movement of the resilient support(s) along the impeller housing. Where the fan comprises a plurality of resilient supports, the impeller housing may comprise a plurality of mounts each connected to a respective resilient support.

The seat may be connected to an upper end of a base of the fan so as to be located within the casing. However, the seat is preferably connected to the casing. The seat preferably extends radially inwardly from a side wall of the casing.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
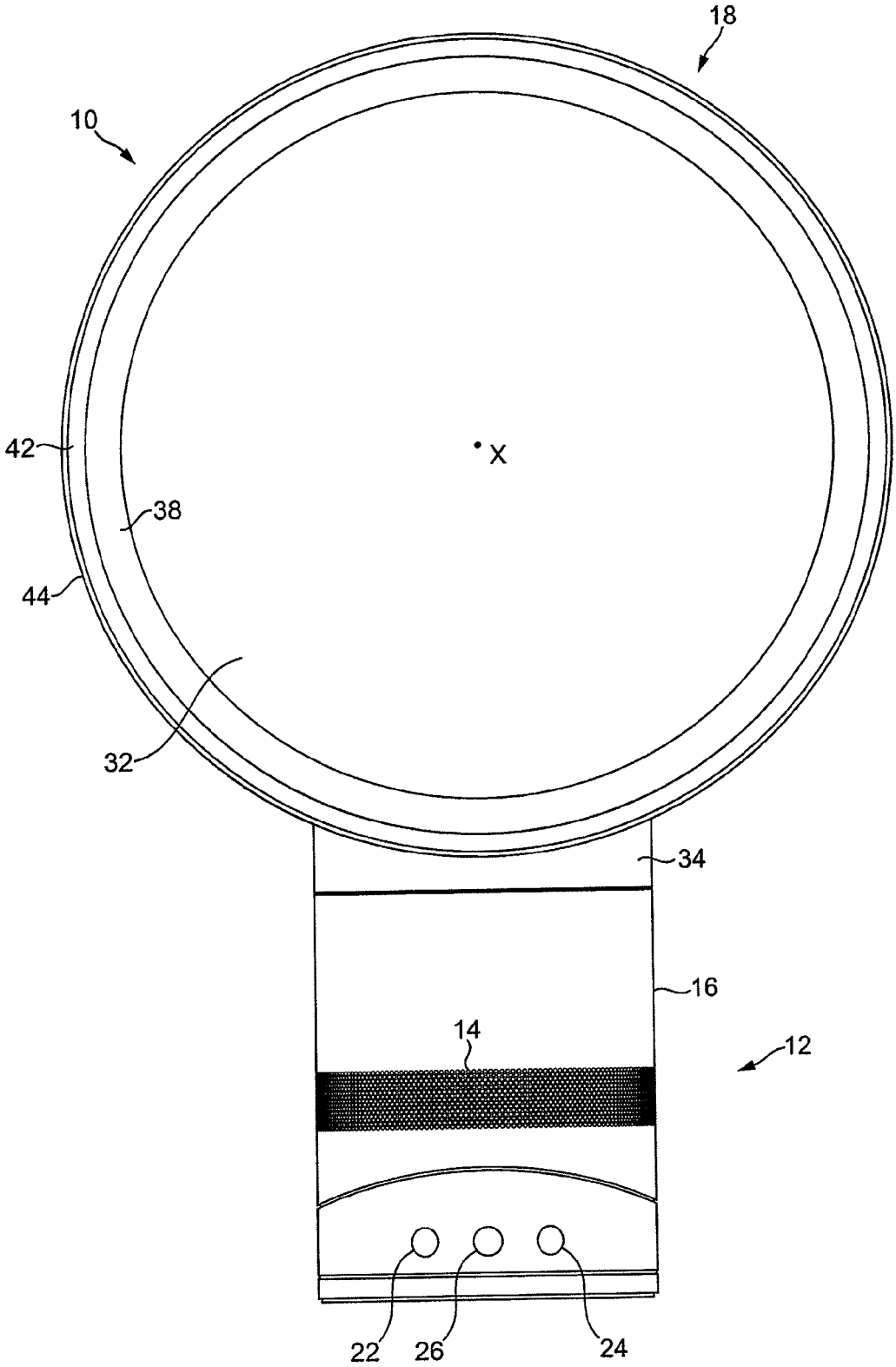
FIG. 1 is a front view of a fan.

FIG. 1 is a front view of a fan 10. The fan comprises a body 12 having an air inlet 14 in the form of a plurality of apertures formed in the outer casing 16 of the body 12, and through which a primary air flow is drawn into the body 12 from the external environment. An annular nozzle 18 having an air outlet 20 for emitting the primary air flow from the fan 10 is connected to the body 12. The body 12 further comprises a user interface for allowing a user to control the operation of the fan 10. The user interface comprises a plurality of user-operable buttons 22, 24 and a user-operable dial 26.

Figure 2:
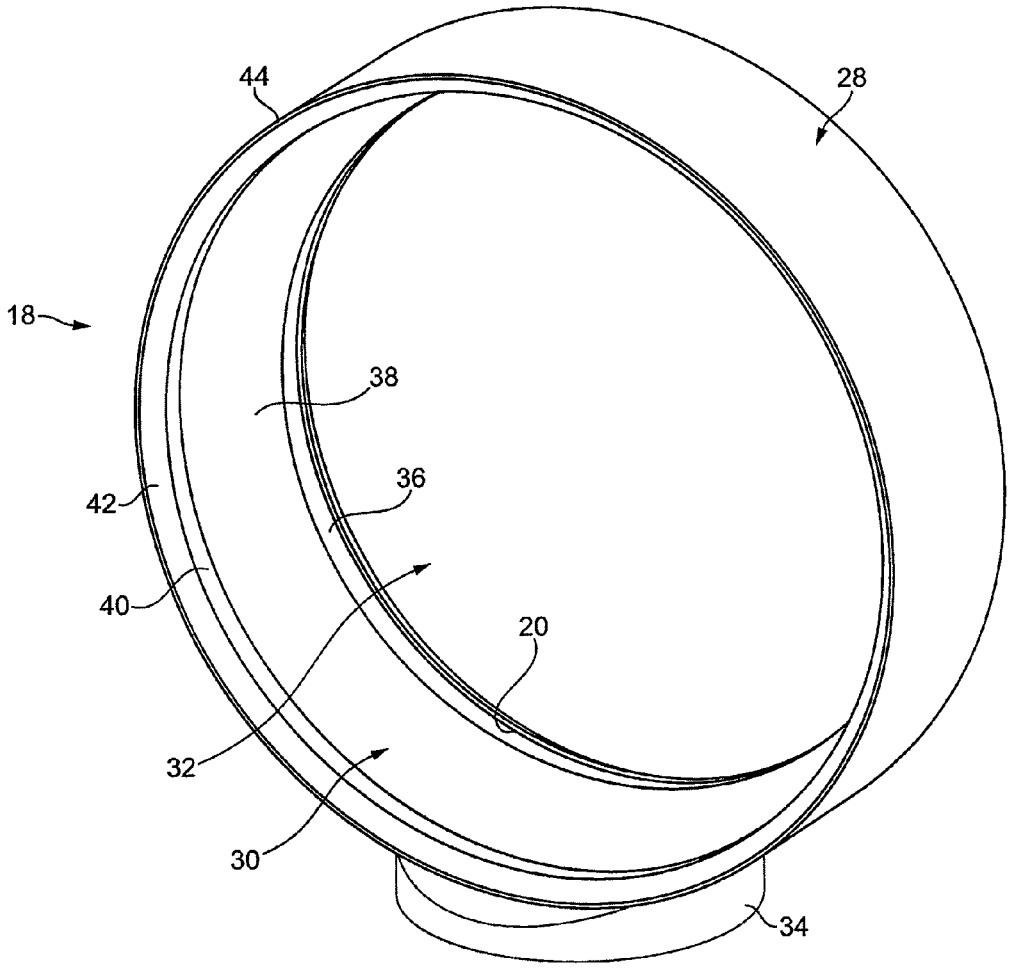
FIG. 2 is a front perspective view, from above, of the air outlet of the fan.
Figure 3:
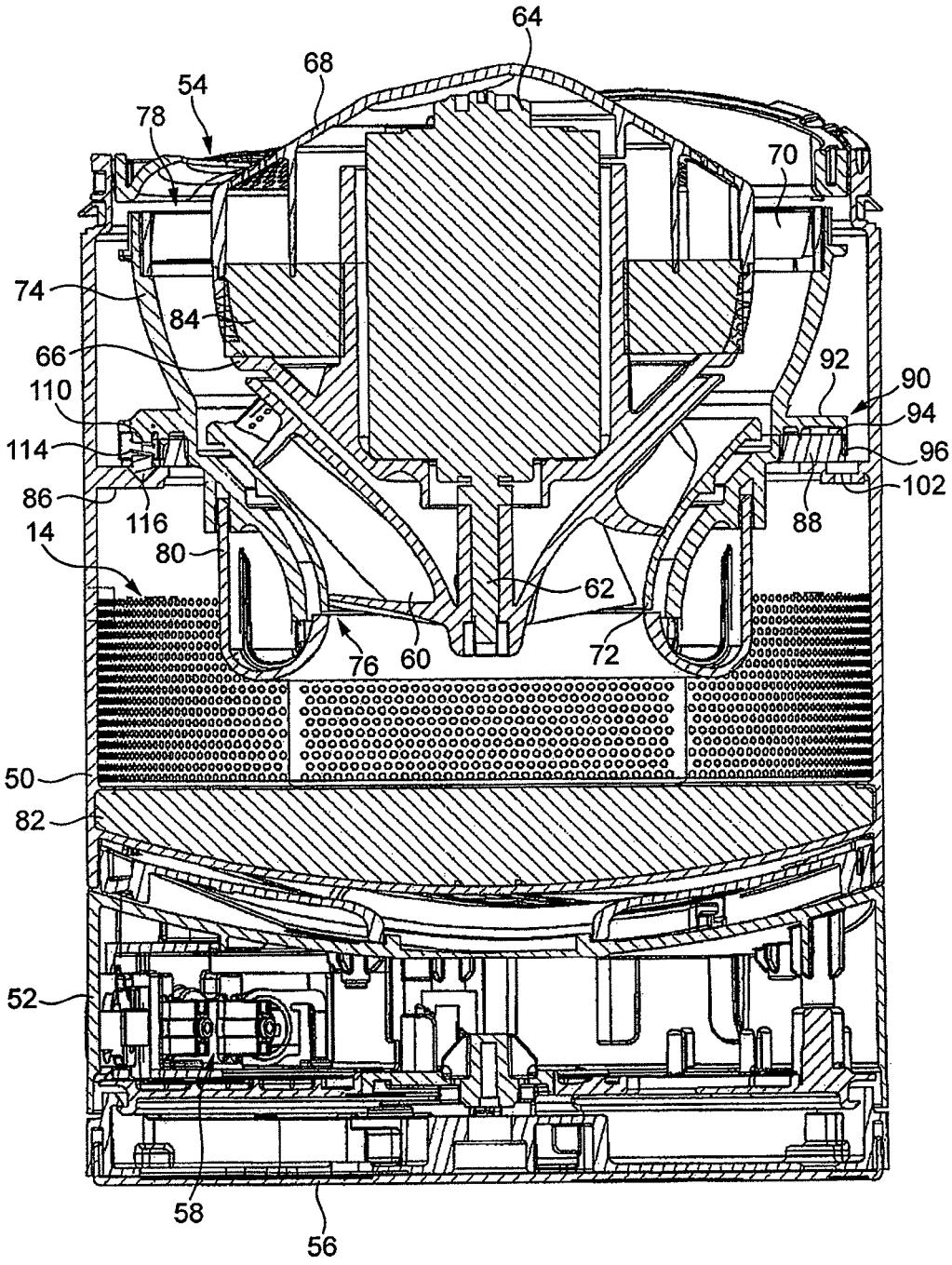
FIG. 3 is a side sectional view of the body of the fan.
Figure 4:
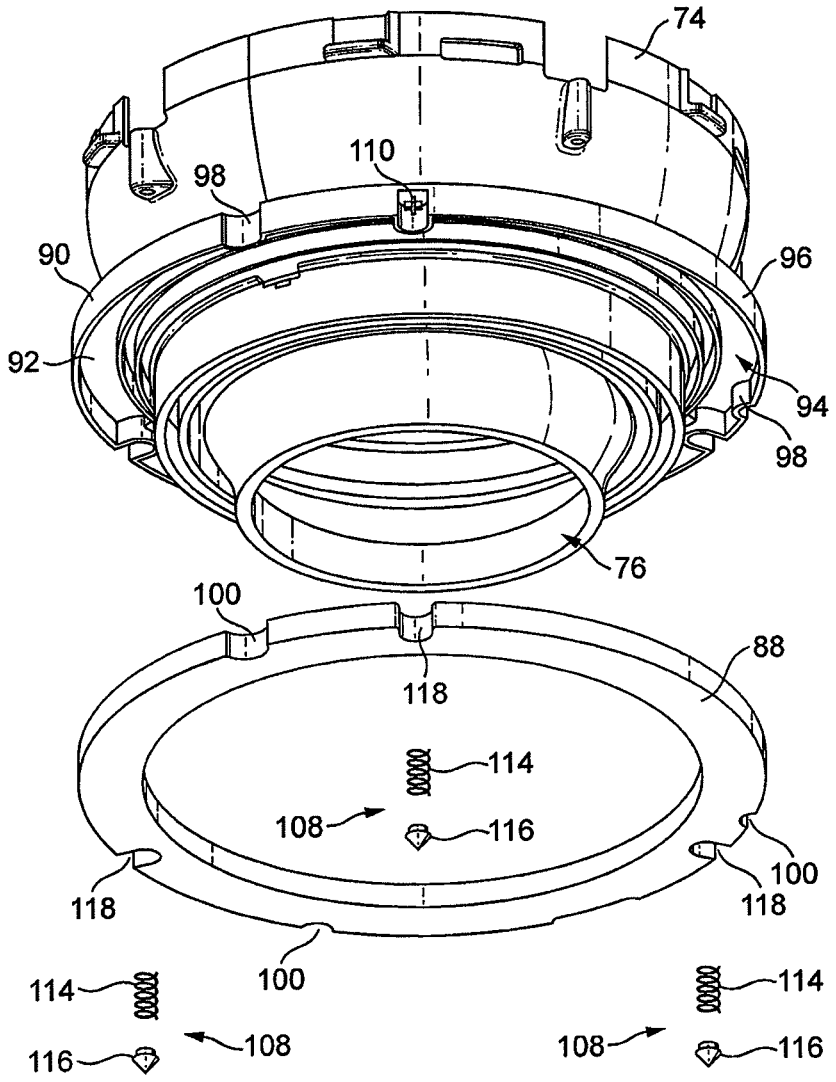
FIG. 4 is an exploded view, from below, of an impeller housing, an annular seal and resilient supports of the lower part of the fan.

As also shown in FIG. 2, the nozzle 18 comprises an annular outer casing section 28 connected to and extending about an annular inner casing section 30. The annular sections 28, 30 of the nozzle 18 extend about and define an opening 32. Each of these sections may be formed from a plurality of connected parts, but in this embodiment each of the outer casing section 28 and the inner casing section 30 is formed from a respective, single moulded part. During assembly, the outer casing section 28 is inserted into a slot located at the front of the inner casing section 30, as illustrated in FIGS. 3 and 4. The outer and inner casing sections 28, 30 may be connected together using an adhesive introduced to the slot. The outer casing section 28 comprises a base 34 which is connected to the open upper end of the outer casing 16 of the body 12, and which has an open lower end for receiving the primary air flow from the body 12.

The outer casing section 28 and the inner casing section 30 together define an annular interior passage for conveying the primary air flow to the air outlet 20. The interior passage is bounded by the internal surface of the outer casing section 28 and the internal surface of the inner casing section 30. The base 34 of the outer casing section 28 is shaped to convey the primary air flow into the interior passage of the nozzle 18.

The air outlet 20 is located towards the rear of the nozzle 18, and is arranged to emit the primary air flow towards the front of the fan 10, through the opening 32. The air outlet 20 extends at least partially about the opening 32, and preferably surrounds the opening 32. The air outlet 20 is defined by overlapping, or facing, portions of the internal surface of the outer casing section 28 and the external surface of the inner casing section 30, respectively, and is in the form of an annular slot, preferably having a relatively constant width in the range from 0.5 to 5 mm. In this example the air outlet has a width of around 1 mm. Spacers may be spaced about the air outlet 20 for urging apart the overlapping portions of the outer casing section 28 and the inner casing section 30 to maintain the width of the air outlet 20 at the desired level. These spacers may be integral with either the outer casing section 28 or the inner casing section 30.

The air outlet 20 is shaped to direct the primary air flow over the external surface of the inner casing section 30. The external surface of the inner casing section 30 comprises a Coanda surface 36 located adjacent the air outlet 20 and over which the air outlet 20 directs the air emitted from the fan 10, a diffuser surface 38 located downstream of the Coanda surface 36 and a guide surface 40 located downstream of the diffuser surface 38. The diffuser surface 38 is arranged to taper away from the central axis X of the opening 32 in such a way so as to assist the flow of air emitted from the fan 10. The angle subtended between the diffuser surface 38 and the central axis X of the opening 32 is in the range from 5 to 25°, and in this example is around 15°. The guide surface 40 is arranged at an angle to the diffuser surface 38 to further assist the efficient delivery of a cooling air flow from the fan 10. The guide surface 40 is preferably arranged substantially parallel to the central axis X of the opening 32 to present a substantially flat and substantially smooth face to the air flow emitted from the air outlet 20. A visually appealing tapered surface 42 is located downstream from the guide surface 40, terminating at a tip surface 44 lying substantially perpendicular to the central axis X of the opening 32. The angle subtended between the tapered surface 42 and the central axis X of the opening 32 is preferably around 45°.

FIG. 3 illustrates a side sectional view through the body 12 of the fan 10. The body 12 comprises a substantially cylindrical main body section 50 mounted on a substantially cylindrical lower body section 52. The main body section 50 and the lower body section 52 are preferably formed from plastics material. The main body section 50 and the lower body section 52 preferably have substantially the same external diameter so that the external surface of the main body section 50 is substantially flush with the external surface of the lower body section 52.

The main body section 50 comprises the air inlet 14 through which the primary air flow enters the fan assembly 10. In this embodiment the air inlet 14 comprises an array of apertures formed in the main body section 50. Alternatively, the air inlet 14 may comprise one or more grilles or meshes mounted within windows formed in the main body section 50. The main body section 50 is open at the upper end (as illustrated) thereof to provide an air outlet 54 through which the primary air flow is exhausted from the body 12 to the nozzle 18.

The main body section 50 may be tilted relative to the lower body section 52 to adjust the direction in which the primary air flow is emitted from the fan assembly 10. For example, the upper surface of the lower body section 52 and the lower surface of the main body section 50 may be provided with interconnecting features which allow the main body section 50 to move relative to the lower body section 52 while preventing the main body section 50 from being lifted from the lower body section 52. For example, the lower body section 52 and the main body section 50 may comprise interlocking L-shaped members.

The lower body section 52 is mounted on a base 56 for engaging a surface on which the fan assembly 10 is located. The lower body section 52 comprises the aforementioned user interface and a control circuit, indicated generally at 58, for controlling various functions of the fan 10 in response to operation of the user interface. The lower body section 52 also houses a mechanism for oscillating the lower body section 52 relative to the base 56. The operation of the oscillation mechanism is controlled by the control circuit 58 in response to the user's depression of the button 24 of the user interface. The range of each oscillation cycle of the lower body section 52 relative to the base 56 is preferably between 60° and 120°, and the oscillation mechanism is arranged to perform around 3 to 5 oscillation cycles per minute. A mains power cable (not shown) for supplying electrical power to the fan 10 extends through an aperture formed in the base 56.

The main body section 50 houses an impeller 60 for drawing the primary air flow through the air inlet 14 and into the body 12. The impeller 60 is connected to a rotary shaft 62 extending outwardly from a motor 64. In this embodiment, the motor 64 is a DC brushless motor having a speed which is variable by the control circuit 58 in response to user manipulation of the dial 26. The maximum speed of the motor 64 is preferably in the range from 5,000 to 10,000 rpm.

The motor 64 is housed within a motor housing. The motor housing comprises a lower section 66 which supports the motor 64, and an upper section 68 connected to the lower section 66. The shaft 62 protrudes through an aperture formed in the lower section 66 of the motor housing to allow the impeller to be connected to the shaft 62. The motor 64 is inserted into the lower section 66 of the motor housing before the upper section 68 is connected to the lower section 66. The upper section 68 comprises an annular diffuser 70 having a plurality of blades for receiving the primary air flow exhausted from the impeller 64 and for guiding the air flow to the air outlet 54 of the main body section 50. A shroud 72 is connected to the outer edges of the blades of the impeller 60.

The motor housing is supported within the main body section 50 by an impeller housing 74. The impeller housing 74 is generally frusto-conical in shape, and comprises an air inlet 76 at the relatively small, outwardly flared lower end thereof (as illustrated) for receiving the primary air flow, and an air outlet 78 at the relatively large, upper end thereof (as illustrated) which is located immediately upstream from the diffuser 72 when the motor housing is supported within the impeller housing 74. The impeller 60, the shroud 72 and the impeller housing 74 are shaped so that when the impeller 60 is supported by the impeller housing 74, the shroud 72 is in close proximity to, but does not contact, the inner surface of the impeller housing 74, and the impeller 60 is substantially co-axial with the impeller housing 74.

An annular inlet member 80 guides an air flow from the air inlet 14 of the outer casing 16 to the air inlet 76 of the impeller housing 74. A disc-shaped foam silencing member 82 is located within the main body section 50, beneath the air inlet 76 of the impeller housing 74. An annular foam silencing member 84 is located within the motor housing.

Figure 5:
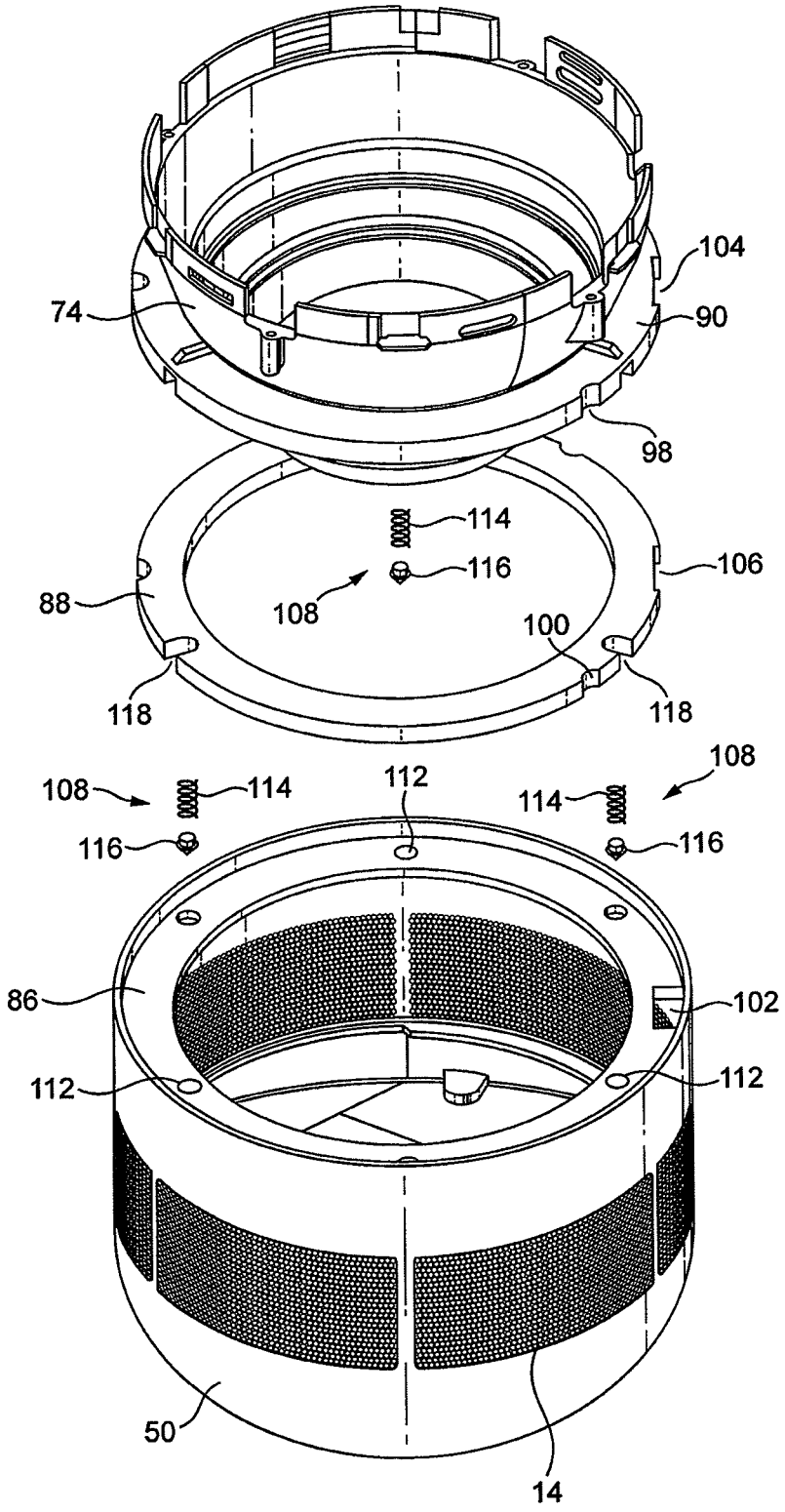
FIG. 5 is an exploded view, from above, of the same components of the fan as illustrated in FIG. 4, and a lower part of the main body section of the body of the casing.

With reference also to FIGS. 4 and 5, the impeller housing 74 is located within the main body section 50 so that the rotational axis of the impeller 60 is substantially co-linear with the longitudinal axis of the main body section 50. The impeller housing 74 is mounted on an annular seat 86 located within the main body section 50. The seat 86 extends radially inwardly from the inner surface of the main body section 50 so that an upper surface of the seat 86 is substantially orthogonal to the rotational axis of the impeller 60.

An annular seal 88 is located between the impeller housing 74 and the seat 86. The annular seal 88 is preferably a foam annular seal, and is preferably formed from a closed cell foam material. In this example, the annular seal 88 is formed from EPDM (ethylene propylene diene monomer) rubber, but the annular seal 88 may be formed from other closed cell foam material which preferably exhibits no more than 0.01 MPa of stress at 10% compression. The outer diameter of the annular seal 88 is preferably smaller than the inner diameter of the main body section 50, so that the annular seal 88 is spaced from the inner surface of the main body section 50.

The annular seal 88 has a lower surface which is in sealing engagement with the upper surface of the seat 86, and an upper surface which is in sealing engagement with the impeller housing 74. In this example, the impeller housing 74 comprises a recessed seal engaging section 90 extending about an outer wall of the impeller housing. The seal engaging section 90 of the impeller housing 74 comprises a flange 92 which defines an annular channel 94 for receiving the annular seal 88. The flange 92 extends radially outwardly from the outer surface of the impeller housing 74 so that a lower surface of the flange 92 is substantially orthogonal to the rotational axis of the impeller 60. The internal periphery of a circumferential lip 96 of the flange 92 and the external periphery of the annular seal 88 are preferably scalloped or otherwise shaped to define a plurality of recesses 98, 100 to inhibit relative rotation between the impeller housing 74 and the annular seal 88.

The seat 86 comprises an aperture 102 to enable a cable (not shown) to pass from the control circuit 58 to the motor 64. Each of the flange 92 of the impeller housing 74 and the annular seal 88 is shaped to define a respective recess 104, 106 to accommodate part of the cable. One or more grommets or other sealing members may be provided about the cable to inhibit the leakage of air through the aperture 102, and between the recesses 104, 106 and the internal surface of the main body section 50.

A plurality of resilient supports 108 are also provided between the impeller housing 74 and the seat 86 for bearing part of the weight of the motor 64, motor housing, impeller 60 and impeller housing 74. The resilient supports 108 are equally spaced from, and equally spaced about, the longitudinal axis of the main body section 50. Each resilient support 108 has a first end which is connected to a respective mount 110 located on the flange 92 of the impeller housing 74, and a second end which is received within a recess 112 formed in the seat 86 to inhibit movement of the resilient support 108 along the seat 86 and about the longitudinal axis of the main body section 50. In this example, each resilient support 108 comprises a spring 114 which is located over a respective mount 110, and a rubber foot 116 which is located with a respective recess 112. Alternatively, the spring 114 and the foot 116 may be replaced by a rod or shaft formed from rubber or other elastic or elastomeric material. As a further alternative, the plurality of resilient supports 108 may be replaced by a single annular resilient support extending about the annular seal 88. In this example, the external periphery of the annular seal 88 is further scalloped or otherwise shaped to form a plurality of recesses 118 each for at least partially receiving a respective resilient support 88. This allows the resilient supports 88 to be located closer to the longitudinal axis of the main body section 50 without either decreasing the radial thickness of the annular seal 80 or increasing the diameter of the main body section 50.

To operate the fan 10 the user presses button 22 of the user interface, in response to which the control circuit 58 activates the motor 64 to rotate the impeller 60. The rotation of the impeller 60 causes a primary air flow to be drawn into the body 12 through the air inlet 14. The user may control the speed of the motor 64, and therefore the rate at which air is drawn into the body 12 through the air inlet 14, by manipulating the dial 26. Depending on the speed of the motor 64, the primary air flow generated by the impeller 60 may be between 20 and 30 liters per second.

The rotation of the impeller 60 by the motor 64 generates vibrations which are transferred through the motor housing and the impeller housing 74 towards the seat 86. The annular seal 88 located between the impeller housing 74 and the seat 86 is compressed under the weight of the motor housing, motor 64, impeller 60 and impeller housing 74 so that it is in sealing engagement with the upper surface of the seat 86 and the lower surface of the flange 92 of the impeller housing 74. The annular seal 88 thus not only prevents the primary air flow from returning to the air inlet 76 of the impeller housing 74 along a path extending between the inner surface of the main body section 50 and the outer surface of the impeller housing 74, but also reduces the transmission of these vibrations to the seat 86, and thus to the body 12 of the fan 10. The presence of the resilient supports 108 between the impeller housing 74 and the seat 86 inhibits any over-compression of the annular seal 88 over time, which otherwise could increase the transmission of vibrations through the annular seal 88 to the seat 86. The flexibility of the resilient supports 108 allows the resilient supports to flex both axially and radially relative to the seat 86, which reduces the transmission of vibrations to the seat 86 through the resilient supports 88. The annular seal 88 serves to damp the flexing movement of the resilient supports 108 relative to the seat 86.

The primary air flow passes sequentially between the impeller 60 and the impeller housing 74, and through the diffuser 72, before passing through the air outlet 54 of the body 12 and into the nozzle 18. Within the nozzle 18, the primary air flow is divided into two air streams which pass in opposite directions around the opening 32 of the nozzle 18. As the air streams pass through the nozzle 18, air is emitted through the air outlet 20. The primary air flow emitted from the air outlet 20 is directed over the Coanda surface 36 of the nozzle 18, causing a secondary air flow to be generated by the entrainment of air from the external environment, specifically from the region around the air outlet 20 and from around the rear of the nozzle 18. This secondary air flow passes through the central opening 32 of the nozzle 18, where it combines with the primary air flow to produce a total air flow, or air current, projected forward from the nozzle 18.

The invention claimed is:

1. A fan comprising:

a casing having an air inlet and an air outlet;

an impeller housing mounted on an annular seat located within the casing, wherein the seat is connected to the casing;

an impeller located within the impeller housing for generating an air flow along a path extending from the air inlet to the air outlet through the impeller housing;

a motor housing connected to the impeller housing;

a motor located within the motor housing for driving the impeller;

an annular seal in sealing engagement with the impeller housing and the seat; and at least one resilient support located between the impeller housing and the seat for reducing the compressive load applied to the annular seal.

2. The fan of claim 1, wherein the seat extends radially inwardly from a side wall of the casing.

3. The fan of claim 1, wherein the impeller housing comprises a recessed section defining an annular channel for receiving the seal.

4. The fan of claim 3, wherein the recessed section comprises a seal engaging surface extending radially outwardly from a side wall of the impeller housing and parallel to the seat.

5. The fan of claim 1, wherein a periphery of the impeller housing and a periphery of the seal are shaped to inhibit rotation of the seal relative to the impeller housing.

6. The fan of claim 1, wherein the at least one resilient support comprises a plurality of resilient supports.

7. The fan of claim 6, wherein the resilient supports are angularly spaced about the impeller housing.

8. The fan of claim 6, wherein a peripheral surface of the seal is profiled so as to form a plurality of recesses each for at least partially receiving a respective resilient support.

9. The fan of claim 6, wherein the impeller housing comprises a plurality of mounts each connected to a respective resilient support.

10. The fan of claim 6, wherein the annular seal comprises a plurality of recesses each for receiving a respective resilient support.

11. The fan of claim 6, wherein each resilient support comprises a respective spring.

12. The fan of claim 1, wherein the annular seal is a foam annular seal.

13. The fan of claim 1, wherein the annular seal is formed from a closed cell foam material.

14. The fan of claim 1, wherein the annular seal is spaced from an inner side surface of the casing.

* * * * *